United States Patent [19]

Miyazaki

[11] 4,217,960

[45] Aug. 19, 1980

[54] FLUSH PENDANT SPRINKLER HEAD HAVING RELATIVELY SLIDABLE DEFLECTOR AND PLUG BODY

[75] Inventor: Tashirou Miyazaki, Menuma, Japan

[73] Assignee: Nohmi Bosai Kogyo Co., Ltd., Japan

[21] Appl. No.: 965,788

[22] Filed: Dec. 4, 1978

[51] Int. Cl.[3] ..... A62C 37/08

[52] U.S. Cl. ..... 169/38; 169/42

[58] Field of Search ..... 169/26, 37–42, 169/57, 90; 126/287.5; 137/72

[56] References Cited

U.S. PATENT DOCUMENTS

| | | | |
|---|---|---|---|
| 316,581 | 4/1885 | Stratton | 169/37 |
| 489,342 | 1/1893 | Stratton . | |
| 551,162 | 12/1895 | Hill | 169/40 |
| 867,004 | 9/1907 | Boardman | 169/40 |
| 2,389,333 | 11/1945 | Tyden | 169/40 |
| 2,591,872 | 4/1952 | Rider . | |
| 3,130,790 | 4/1964 | Hodgman . | |
| 3,195,647 | 7/1965 | Campbell et al. | 137/72 X |
| 4,015,665 | 4/1977 | Simons et al. | 169/42 X |

FOREIGN PATENT DOCUMENTS 49-21356 6/1974 Japan .

*Primary Examiner*—Robert J. Spar
*Assistant Examiner*—Fred A. Silverberg
*Attorney, Agent, or Firm*—Larson, Taylor and Hinds

[57] ABSTRACT

For the purpose of making its overall dimension small an automatic sprinkler of the flush type generally comprising a sprinkler body having a discharge orifice, a plug body to sealingly close the discharge orifice, levers associated with a soldered link to force the plug body to close the discharging orifice when assembled and a deflector to uniformly distribute water flowing under pressure through the discharge orifice when the plug body operates, the deflector being arranged outside and directly below the sprinkler body, the deflector being slidably connected to the sprinkler body by way of guide bars.

6 Claims, 3 Drawing Figures

FLUSH PENDANT SPRINKLER HEAD HAVING RELATIVELY SLIDABLE DEFLECTOR AND PLUG BODY

BACKGROUND OF THE INVENTION

The present invention relates to an automatic sprinkler and more particularly to an improvement in an automatic sprinkler of the flush type in which in operation a deflector drops to a predetermined position to begin to discharge water thereabout.

The conventional automatic sprinklers of this kind have all suffered from their dimensions being made large owing to the fact that, as apparent from e.g. Japan Patent Publication No. 21356/1974; U.S. Pat. Nos. 489,342; 2,591,872; 3,130,790 and 3,195,647, etc. the deflector, guides for slidingly supporting it, etc. are provided within a cylindrical sprinkler body, causing the diameter of the body to be large and its length long. As a result, when the sprinkler is mounted on the surface of a room ceiling or the like or embodied in the ceiling it considerably damages the fine appearance of the ceiling or the like.

SUMMARY OF THE DISCLOSURE

It is a principal object of the present invention to provide an automatic sprinkler of the flush type which is small in dimension so that it by no means damages the appearance of the place on which it is mounted or into which it is embedded.

According to the present invention, an automatic sprinkler of the flush type is provided in which a deflector is arranged outside and directly below a sprinkler body, the deflector being mounted to the sprinkler body by guide bars to which the deflector is secured and which are shiftably mounted to the sprinkler body.

In accordance with one aspect of the present invention the guide bars are shiftably mounted to the sprinkler body in such a manner that they loosely pass through small holes formed in the bottom of a cylindrical frame which is secured to the lower end of the sprinkler body.

In accordance with another aspect of the present invention a soldered link having a constitution similar to that used in a conventional automatic sprinkler of the type referred to above is provided to sealingly close the discharge orifice of the sprinkler body with a plug body with the levers being laid on the surface of the bottom of the cylindrical frame and their leg portions being passed through the central opening formed in the deflector.

BRIEF DESCRIPTION OF THE DRAWINGS

This and other objects of the present invention will become more readily apparent upon reading the following specification and upon reference to the accompanying drawings, in which.

DESCRIPTION OF THE PREFERRED EMBODIMENT

Figure 1:
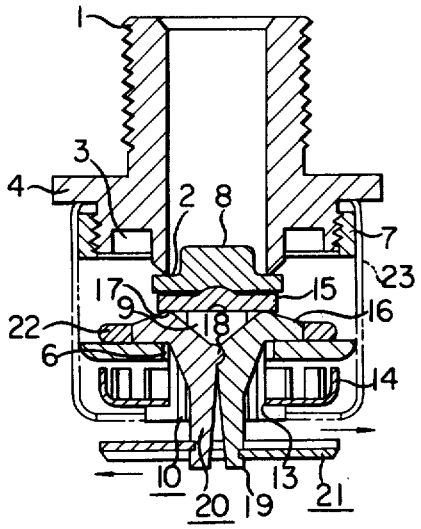
FIG. 1 is a longitudinal sectional front view of one embodiment of the automatic sprinkler according to the present invention.
Figure 2:
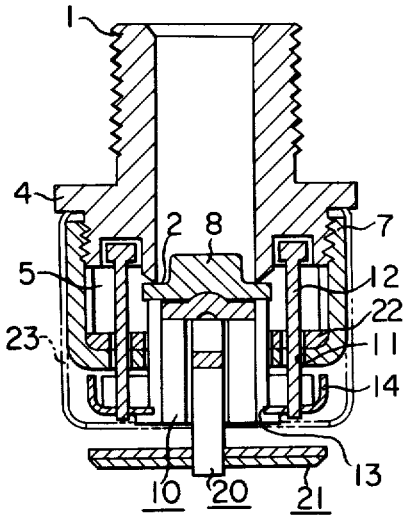
FIG. 2 is a longitudinal sectional side view of the sprinkler shown in FIG. 1.

Referring now to FIGS. 1 and 2 of the drawings, a sprinkler body 1 having generally a cylindrical shape with a nipple for connection with the water supply pipe being formed outside at the upper part is provided with a discharge orifice 2 at its lower end axially for discharging pressurized water and a flange 4 on its outer periphery at the lower part with an annular groove 3 being formed in the bottom surface. Screwed to sprinkler body 1 on the outer periphery of flange 4 is the upper portion of a cylindrical frame 7 which is provided with a number of slots 5 in its peripheral wall and a central guide hole 6 in its bottom.

Received within frame 7 is a cylindrical plug body 10 which is provided with a protruding head part 8 to close discharge orifice 2 and a depending cylindrical part 10 having two pairs of vertical slots 9, each disposed diametrically and orthogonally to each other whereby the head part as well as the depending cylindrical part of plug body 10 are adapted to freely drop through guide hole 6 in the bottom of frame 7 when plug body 10 operates as will be more fully explained later. Further, all or some of the lower end portions of the depending cylindrical part of plug body 10 are bent outwards to receive the under surface of a deflector 14 to be explained below. Slidably introduced into small holes 11 formed diametrically in the bottom of frame 7 near the outer periphery are guide bars 12, each prevented from falling out of the bottom of frame 7 by the engagement of its enlarged top end portion with the upper surface of the bottom of frame 7. Fixedly secured to guide bars 12 at their ends is the deflector 14 which has generally a dish-like shape with a peripheral wall bent upwards therefrom and which is provided with a central opening 13 into which is slidably received the depending cylindrical part of said plug body 10, central opening 13 being provided on its periphery with corresponding pairs of projections, one of the pairs being adapted to slidably engage with one of two pairs of vertical slots 9 of plug body 10 as well as to seat the lower surface of head part 8 of plug body 10 when it operates. At this point, it should be appreciated also that as abovesaid, deflector 14 rests on the bent lower end portions of the depending cylindrical part of plug body 10 in the assembled state. See FIG. 1. A circular disk-shaped balancer 15 which has a central protrusion on its upper surface has a pair of projections disposed diameterically on its periphery, each adapted to loosely fit within one pair of vertical slots 9 of plug body 10. A pair of levers 20, each having a flat J-shaped form with a claw portion 16, a head portion 17, a bent back portion 18 and a leg portion 19, are generally disposed back to back with each other and are each loosely introduced into the other pair of vertical slots 9 so that they thrust each other at bent back portions 18, claw portions 16 lying on stepped portions formed around the periphery of guide hole 6 in the bottom of frame 7, head portions 17 engaging with the bottom of head part 8 of plug body 10 through a balancer 15, and leg portions 19 being disposed into a hole provided in a soldered link 21 which comprises two circular discs put on top of each other, each having a radial slot somewhat longer than its radius, the hole being formed with the radial slots elongated diametrically oppositely and the confronting surfaces soldered together with a fusible alloy. At this point, reference should be made also to the fact that one of levers 20 is provided with a projection on bent back portion 18, whereas the other is provided with a dent portion to be smoothly engaged with the projection on bent back portion 18 of the one.

So far as this mechanism for holding plug body 10 in sealing contact with discharge orifice 2 is concerned, it is conventional. That is, when frame 7 is strongly screwed to sprinkler body 1, frame 7 is given a predetermined elastic force from the assembled levers 20 in which claw portions 16 lie on the periphery of guide hole 6 in the bottom of frame 7 and head portions 17 urge head part 8 of plug body 10 upwards to close discharge orifice 2 of sprinkler body 1 under a predetermined pressure, and upon subjection of soldered link 21 to heat at a predetermined temperature the assembly dismantles to open discharge orifice 2 in a manner well-known in the art.

Although in the above explanation the stepped portions for receiving claw portions 16 of levers 20 are referred to as being formed directly on the surface of the bottom of frame 7, they may be formed, as shown in FIGS. 1 and 2, on a disc 22 which is adapted to be put on the bottom of frame 7 and has a central hole corresponding to guide hole 6 formed in the bottom of frame 7, the stepped portions being formed on disc 22 around the central hole.

Now the operation of the automatic sprinkler according to the present invention having a constitution as explained so far, will be described below.

As usual in the conventional automatic sprinklers of this type having a soldered link constitution similar to the present one, when soldered link 21 is subjected to heat due to e.g. a fire, the adhereing surfaces of the circular discs forming the link are fused to lose their original adhering strength so that they are instantaneously scattered along the radial slots in opposite directions as shown by the arrows in FIG. 1 owing to the torque applied to leg portions 19 of levers 20 due to their subjection to the elastic force from plug body 10 through their head portions 17.

Figure 3:
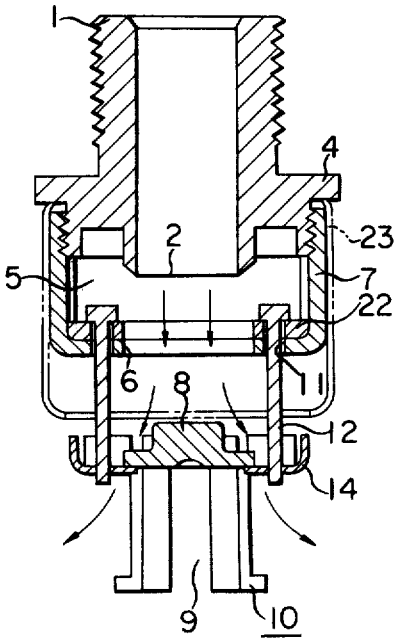
FIG. 3 is a longitudinal sectional side view of the sprinkler shown in FIGS. 1 and 2 in the state of operation.

When this happens, levers 20 fall out of the inside of plug body 10 due to the disengagement of claw portions 16 of levers 20 from the surface of the bottom of frame 7 owing to the torque. As a result, plug body 10 falls down through the central hole of disc 22 through guide hole 6 formed in the bottom of frame 7 as well as central opening 13 formed in the bottom of deflector 14 so that the under surface of head part 8 of plug body 10 sits on the projections of central opening 13 and at the same time deflector 14 falls together with guide bars 12 which are guided along small holes 11 formed in the bottom of frame 7 to be stopped by the engagement of their widened top ends with the surface of the bottom of frame 7. Fee FIG. 3.

In this state the pressurized water discharges from discharge orifice 2 to be reflected on the upper surface of head part 8 of plug body 10 and flushes towards the peripheral protrusion of dish-like deflector 14 or flows directly through radial grooves formed in the peripheral wall so that it uniformly distributes thereabout.

In this case, by the suitable intergral selection of the height of the projected portion of head part 8 of plug body 10, the diameter of deflector 14, and the bent up height of the peripheral wall formed around deflector 14, etc., e.g. by changing the height of the projecting portion of head part 8, the pattern of the scattered water can be regulated at will.

At this point it should be mentioned that if an ornamental pleasing sight is required, frame 7 may be covered with a cylindrical cover 23 by any means, e.g. by a spring force so as to be dismountable as shown in FIGS. 1 and 2 with the phantom lines. Further, in the embodiment shown, although the total height of the automatic sprinkler is made short by introducing the upper ends of guide bars 12 into annular groove 3 formed in the under surface of flange 4 of sprinkler body 1 when assembled, annular groove 3 may be omitted when there is no need of shortening the overall height so much. Furthermore, in the embodiment shown, although two sets of vertical slots 9 are necessary for plug body 10 owing to the provision of balancer 15, if no balancer 15 is provided only single set of vertical slots 9 need be formed in plug body 10 so that the protrusions formed on the periphery of central opening 13 in the bottom of deflector 14 and levers 20 are both introduced into them.

Thus, it will be appreciated that according to the present invention, since only guide bars 12, each having a small diameter, are received within frame 7 and deflector 14 is provided outside frame 7 so as to be located directly below frame 7, sprinkler body 1 and frame 7 are both made small, resulting in an automatic sprinkler which is small in dimentions and does not injure the pleasing appearance of room ceilings etc., when it is mounted to their surfaces or embedded in them.

What is claimed is:

1. An automatic sprinkler of the flush type wherein a discharge orifice formed axially in a sprinkler body is adapted to be sealingly closed by a plug body in the assembled state through lever means supported in said sprinkler body in association with a soldered link, characterized in that a deflector means is arranged outside and directly below a cylindrical frame which is connected to the lower end of said sprinkler body and said deflector means is secured to guide bars which are shiftably mounted to said sprinkler body, wherein in the moved state said plug body moves to open said orifice and said deflector means drops below said discharge orifice at a distance determined by the length of said guide bars to uniformly distribute the water discharged through said discharge orifice, and wherein said plug body has generally cylindrical form with a head part to close said discharge orifice and a depending cylindrical part provided with a number of pairs of vertical slots disposed diametrically, all or some of the lower end portions of said depending cylindrical part being bent outward, said cylindrical frame having a central opening in the bottom to allow the free fall of said plug body when it moves to open said orifice, and a corresponding number of small holes to shiftably receive said guide bars, said deflector means resting on said bent lower end portions of said depending cylindrical part of said plug body in the assembled state.

2. An automatic sprinkler as claimed in claim 1 wherein said deflector means is provided with a central opening to longitudinally slidably receive said depending cylindrical part of said plug body, the periphery of said central opening of said deflector means being provided with a corresponding number of projections to be in longitudinally slidable contact with said vertical slots of said plug body and at the same time to come into contact with said head part of said plug body when it moves to open said orifice, whereby in the assembled state said plug body supports said deflector means, and in the moved state said deflector means supports said plug body.

3. An automatic sprinkler as claimed in claim 1 or 2 wherein said lever means comprises a pair of levers generally disposed back to back with each other within one of said pairs of said vertical slots of said plug body and said soldered link is disposed below said deflector means, each of said levers having a symmetrical flat J-shaped form, a claw portion, a head portion, a bent back portion, and a leg portion, and said soldered link comprises two circular metal discs put on top of each other, each of said discs having a radial slot somewhat longer than its radius, whereby in the assembled state said levers thrust said head part of said plug body against said discharge orifice of said sprinkler body with said head portions of said levers with said claw portions resting on the periphery of said central opening of said frame, and said leg portion being introduced into an opening formed by said two metal discs of said soldered link with said radial slots being elongated diametrically oppositely and the confronting surfaces being soldered together with a fusible alloy.

4. An automatic sprinkler as claimed in claim 1 or 2 wherein a cylindrical cover having a central opening in the bottom to allow the free fall of said deflector means is detachably mounted to said sprinkler body at its lower part.

5. An automatic sprinkler as claimed in claim 3, wherein a cylindrical cover having a central opening in the bottom to allow the free-fall of said deflector means is detachably mounted to said sprinkler body at its lower part.

6. An automatic sprinkler of the flush type wherein a discharge orifice formed axially in a sprinkler body is adapted to be sealingly closed by a plug body in the assembled state through lever means supported in said sprinkler body in association with a soldered link, characterized in that a deflector means is arranged outside and directly below a cylindrical frame which is connected to the lower end of said sprinkler body and said deflector means is secured to guide bars which are shiftably mounted to said sprinkler body, wherein in the moved state said plug body moves to open said orifice and said deflector means drops below said discharge orifice at a distance determined by the length of said guide bars to uniformly distribute the water discharged through said discharge orifice, and wherein said plug body, in the assembled state, is disposed partially within said cylindrical frame and has a protruding portion that protrudes through an opening formed in the bottom of said cylindrical frame such that when released to the moved state, the plug body can fall freely through said opening, said deflector means being longitudinally slidably mounted on the protruding portion of said plug body outside of said cylindrical frame such that the dimensions of said sprinkler body and said cylindrical frame are not dictated by the need to house said deflector means, and wherein, in the assembled state, the protruding portion of said plug body supports said deflector means, and in the moved state said deflector means supports said plug body.

* * * * *